United States Patent [19]

Frigo

[11] 4,191,944

[45] Mar. 4, 1980

[54] ELECTROMAGNETIC SOUND GENERATOR AND METHOD OF MAKING SAME

[75] Inventor: Domenico Frigo, Olmo, Italy

[73] Assignee: Fiamm S.p.A. Fabbrica Italiana Accumulatori Motocarri Montecchio, Montecchio Maggiore, Italy

[21] Appl. No.: 944,567

[22] Filed: Sep. 21, 1978

Related U.S. Application Data

[62] Division of Ser. No. 765,077, Feb. 3, 1977, Pat. No. 4,134,200.

[30] Foreign Application Priority Data

Feb. 4, 1976 [IT] Italy ..... 19876 A/76

[51] Int. Cl.[2] ..... G08B 3/10

[52] U.S. Cl. ..... 340/388; 340/391

[58] Field of Search ..... 340/388; 179/115 R

[56] References Cited

U.S. PATENT DOCUMENTS 3,041,601 6/1962 Wetzel ..... 340/388

*Primary Examiner*—Harold I. Pitts

*Attorney, Agent, or Firm*—Karl F. Ross

[57] ABSTRACT

An electromagnetic sound generator, such as an automobile horn, has a thin-walled ferromagnetic housing closed at one end by a membrane which carries an armature extending into an electromagnetic coil mounted in the housing. The rim of the membrane is embraced by a deformable peripheral housing wall bent back upon itself to form an outwardly projecting peripheral flange with a bight portion radially spaced from the membrane, the housing wall extending axially beyond this flange to engage a resonator adjoining the membrane. The armature has an eccentric lug which coacts with a contact spring of an interrupter in series with the coil and which can be limitedly adjusted, by rotation of the armature about its axis, to shift its point of engagement with the contact spring for varying the moment arm of the spring and thus the natural frequency of the sound generator. In assembling the housing and the membrane, a stepped portion of the peripheral housing wall is first deformed radially inwardly to form a beveled neck which is then flattened axially against the membrane resting on an internal shoulder of that wall.

16 Claims, 13 Drawing Figures

ELECTROMAGNETIC SOUND GENERATOR AND METHOD OF MAKING SAME

This is a division of application Ser. No. 765,077, filed Feb. 3, 1977, now U.S. Pat. No. 4,134,200.

FIELD OF THE INVENTION

My present invention relates to an electromagnetic sound generator, such as an automobile horn, and to a method of assembling the components thereof.

BACKGROUND OF THE INVENTION

A sound generator of this character usually comprises a ferromagnetic membrane coacting with an electromagnetic coil in a housing of ferromagnetic material which forms part of a magnetic circuit also including the membrane and an armature carried thereon. The housing, for this purpose, has an open end spanned by the membrane whose rim is conventionally clamped between a flange of the housing and an adjoining resonator. The vibrations of the resonator subject the membrane to considerable stresses, leading to its early deterioration if, as is customary, the membrane is firmly gripped by rivets, screws or a crimped housing edge.

OBJECTS OF THE INVENTION

An important object of my present invention, therefore, is to provide an improved method of mounting such a membrane on its housing in a secure and virtually stress-free manner.

Another object of my invention, allied with the preceding one, is to provide an improved mounting for a membrane on an open-topped housing between an electromagnetic coil and a resonator.

A further object of this invention is to provide means in such a sound generator for adjusting the operation of an interrupter to vary the frequency and/or amplitude of the emitted acoustic signals.

SUMMARY OF THE INVENTION

According to one aspect of the present invention, I provide a generator housing of ferromagnetic sheet metal with a thin, deformable peripheral wall centered on an axis, this wall forming an internal annular shoulder which faces an open end of the housing and on which a circular ferromagnetic membrane is placed with its rim within a generally cylindrical end portion of the wall. I then deform that end portion radially inwardly all around its axis, preferably with the aid of a roller pressing it against a mandrel, so as to form a beveled neck overhanging the membrane rim; by axially flattening that neck against the membrane-supporting shoulder, I sandwich the rim between parallel plies of an annular portion of the housing wall folded back upon itself to constitute an external peripheral flange. This folding-back operation is preferably carried out along a perimeter whose radius exceeds that of the membrane, whereby an annular clearance is provided between the membrane rim and the surrounding bight portion of the flange.

In order to prevent any dislodgment of the membrane from its seat within the flange, a peripheral zone of the membrane may be provided with apertures into which parts of adjoining flange cheeks can be pressed to engage the membrane with a minimum of constraint.

According to another aspect of my invention, an armature carried by the membrane is mechanically coupled with a projection overlying a leaf spring which carries an interrupter contact whose mate is mounted on an arm juxtaposed with that leaf spring within the housing, the arm and the leaf spring extending generally transversely to the housing axis alongside the armature. Both the arm and the spring may be fixedly secured to the housing at one end with interposition of an insulating strip so shaped, as more fully described hereinafter, to keep the confronting contact faces parallel to each other upon their separation by the axial entrainment of the leaf spring when an eccentric projection of the armature engages the leaf spring near a longitudinal edge thereof at a location offset from its centerline. The interposed strip also insures a substantially constant contact pressure when the arm, which should be somewhat flexible for this purpose, is axially adjusted to vary the stroke of the armature and thereby the sound amplitude. A rotation of the armature about its axis, with or without the membrane, enables a limited displacement of the projection along the edge of the leaf spring to change the natural frequency of the oscillatory system and therefore the tuning of the sound generator.

An end portion of the peripheral housing wall, projecting axially beyond the membrane and its supporting flange, advantageously surrounds at least part of the adjoining resonator as a protective enclosure and/or as a means for anchoring the resonator to the housing.

BRIEF DESCRIPTION OF THE DRAWING

The above and other features of my invention will now be described in detail with reference to the accompanying drawing in which.

SPECIFIC DESCRIPTION

Figure 1:
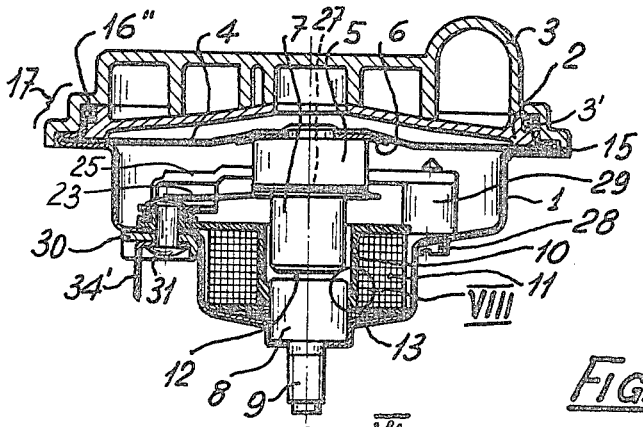
FIG. 1 is an axial sectional view of a sound generator according to my invention, taken on the line I—I of FIG. 2.

In FIG. 1–4 of the drawing I have shown a sound generator comprising a housing 1 of sheet steel centered on an axis 0; this housing has an open end spanned by a membrane 4 of similar material. The membrane is overlain by a resonator in the form of a convoluted shell split into two parts along a plane perpendicular to axis 0, i.e. a bottom part 2 (as viewed in FIG. 1) adjoining the membrane 4 and a top part 3 secured to part 2 by adhesive bonding or in some other convenient way. Membrane 4 is underlain by a ferromagnetic disk 6, separating it from an enlarged head 5 of a magnetic armature 7 which has a peened-over boss 7' (FIG. 11) traversing the disk and the membrane in order to secure these elements to one another; head 5 serves as an inertial mass. Disk 6 has a diameter substantially smaller than that of membrane 4 but larger than that of armature head 5 and, with its more limited elasticity, serves to stiffen the membrane at its center while also increasing its effective magnetic cross-section to lower the reluctance of a magnetic circuit traversed by flux from a coil 11. That magnetic circuit includes a stationary core 8 of coil 11, supported by a coil carrier 10 at the end of housing 1 remote from membrane 4, along with the housing itself and the membrane. Core 8 has a threaded extension 9 projecting from the housing to facilitate its mounting on an external support such as the body of an automotive vehicle.

Figures 4, 5, 6, 7, 8, 9, 10, 11:
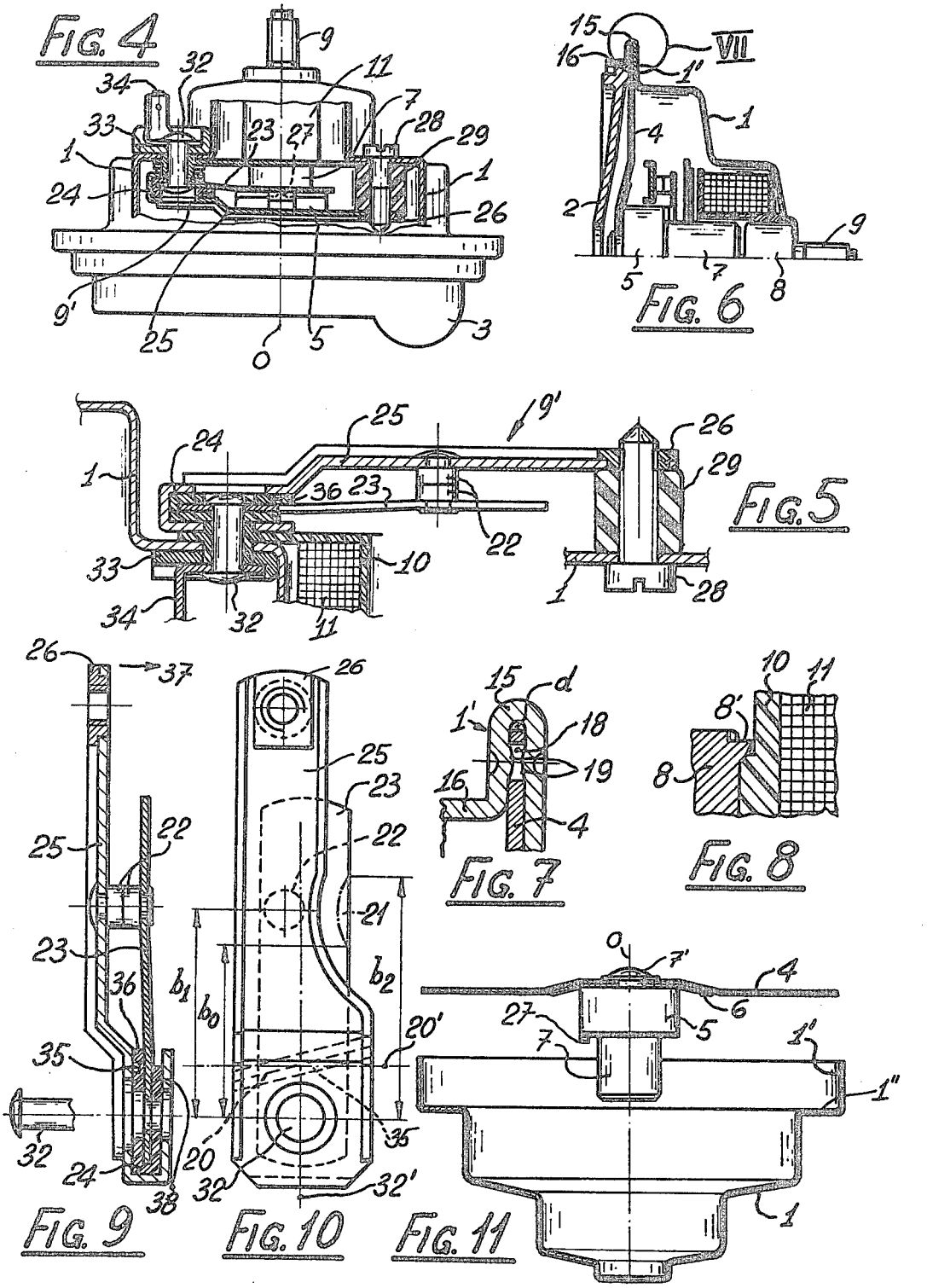
FIG. 4 is a side view of the assembly, partly in section on the line IV—IV of FIG. 2.
FIG. 5 is a sectional detail view drawn to a larger scale, taken on the line V—V of FIG. 3, showing an interrupter and associated elements.
FIG. 6 is a fragmentary sectional view taken on the line VI—VI of FIG. 2.
FIG. 7 is an enlarged sectional view of a detail within the area VII of FIG. 6.
FIG. 8 is an enlarged sectional view of a detail within the area VIII of FIG. 1.
FIG. 9 is a sectional view of the interrupter shown in FIG. 5.
FIG. 10 is a top view of the interrupter shown in FIG. 9.
FIG. 11 is a cross-sectional view of the housing and its membrane in a first stage of assembly.

Core 8 is immobilized with reference to coil support 10 by means of teeth 8' partly chipped out of its surface, as illustrated in FIG. 8. A ferromagnetic disk 13 at the bottom of the housing (as viewed in FIG. 1) also serves to reduce the reluctance of the magnetic path.

Core 8 and armature 7 are axially separated from each other within coil 11 by an air gap 12 whose width decreases upon the energization of the coil. An eccentric lug 27 on armature head 5, overlying a longitudinal edge of a conductive blade 23 acting as a leaf spring, then entrains that blade away from an associated metallic arm 25 to separate a pair of contacts 22 respectively carried on blade 23 and on arm 25 as shown in FIGS. 5, 9 and 10. Contacts 22 are part of an interrupter 9' inserted in the energizing circuit of coil 11 which also includes a pair of rivets 31 and 32. Rivet 32 traverses the housing wall, an extension of the coil carrier 10 and an end of blade 23 with which it is both electrically and mechanically connected as best seen in FIG. 5. An extremity of arm 25 enfolds the fixed end of blade 23 with interposition of an insulating strip 24. The opposite end of arm 25 carries a nut 26 of dielectric material engaged by a screw 28 which passes through a resilient pad 29. Rotation of screw 28, which also traverses the housing wall, enables a limited axial adjustment of arm 25 and blade 23 together with their contacts 22. In order to keep the pressure of these contacts in the deenergized state of coil 11 independent of the armature stroke as determined by the setting of screw 28, the upper leg of strip 24 (as viewed in FIG. 5) has an end 36 projecting beyond its lower leg to bend the blade 23 toward coil 10 when the arm 25 is flexed in the same sense as indicated by an arrow 37 in FIG. 9.

Strip end 36 terminates in a generally transverse edge 20, best seen in FIG. 10, which extends obliquely to the centerline 32' of leaf spring 23 so as to include with that edge an acute angle whose vertex points toward an area 21 which confronts the lug 27 on armature head 5. If the transverse strip edge coincided with a line 20' perpendicular to centerline 32', the asymmetrical pressure exerted upon leaf spring 23 by the lug 27 would result in a twisting of that spring and therefore a mutual disalignment of interrupter contacts 22. With the inclination of edge 20, as illustrated, the stiffness of blade 23 diminishes from area 21 to the opposite blade edge so that substantially no twisting occurs as the blade is moved away from arm 25. The resiliency of the projecting strip end 36 is increased by the presence of an oblique surface groove 35 paralleling the edge 20.

To a limited extent, the moment arm of leaf spring or blade 23 can be varied by rotating the armature 5,7 (with or without membrane 4) about axis 0, e.g. with the aid of a slot provided for this purpose in boss 7'. This rotation displaces the lug 27 along an arc bounding the area 21 whereby the distance of its point of engagement from the fixed end of blade 23 is lengthened or shortened as indicated at $b_0$, $b_1$, $b_2$ in FIG. 10. Strip 24, besides acting as an insulator, also has a certain damping effect.

Arm 25, blade 23 and contacts 22 of interrupter 9' lie in series with coil 11 via a nonillustrated connection extending from that arm to the coil. The circuit is completed by a connection, also not shown, from coil 11 to rivet 31 and to an attached terminal 34' which is insulated from housing 1 by a dielectric spacer 30. A similar spacer 33 separates the housing from a terminal 34 engaged by rivet 32.

If desired, spacer 30 could be removed with rivet 31 bearing directly upon the metallic housing 1 which is grounded to the vehicle body or other external support.

As best seen in FIGS. 6 and 7, a peripheral wall 1' of housing 1 is folded back upon itself to form an external peripheral flange 15 whose two plies sandwich the rim of membrane 4 between them, wall 1' terminating in a tubular end portion 16 extending axially beyond flange 15. An annular clearance d is left between the bight portion of flange 15 and the periphery of the membrane which thus retains a limited mobility in its plane. Membrane 4 is formed near its rim with a number of peripherally spaced apertures 18 receiving bulges 19 of the housing wall formed on confronting surfaces of flange 15, these bulges entering the apertures to hold it centered on axis 0 without clamping action. The apertures 18 may have the shape of arcuate slots enabling limited rotation of the membrane in its seat for the purpose of displacing the point of engagement between blade 23 and lug 27, as described above. The bulges 19 can be produced by an inward deformation of the confronting flange cheeks, as shown, but could also be formed by a mere local thickening of these cheeks.

Figure 12:
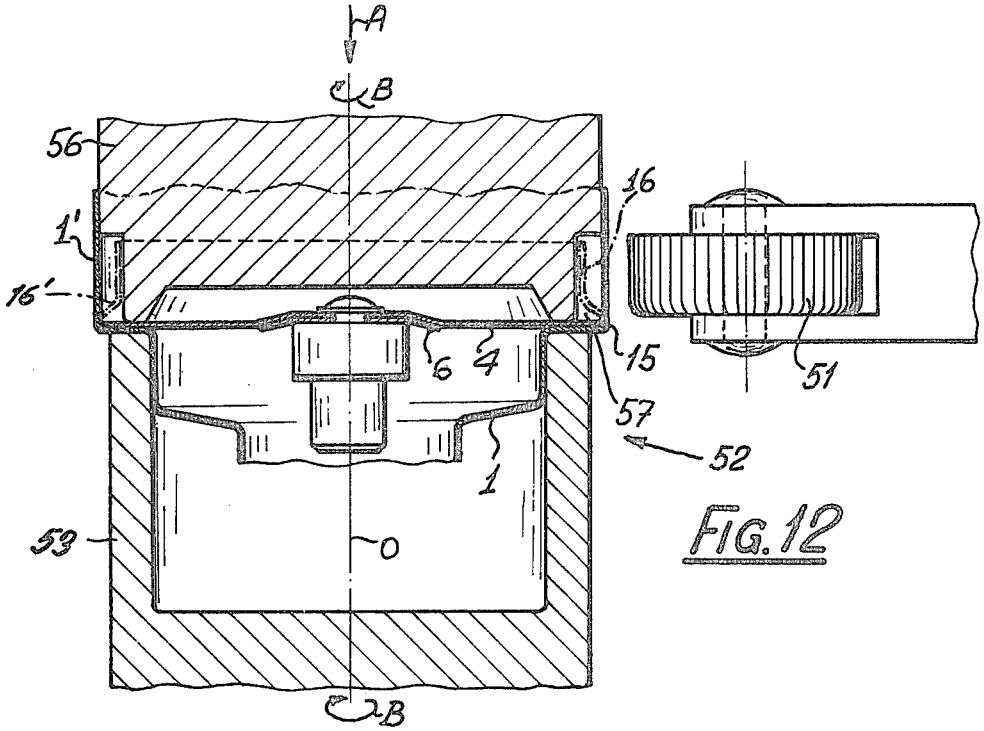
FIG. 12 is a somewhat diagrammatic view of a device used in another stage of assembly of the parts shown in FIG. 11.
Figure 13:
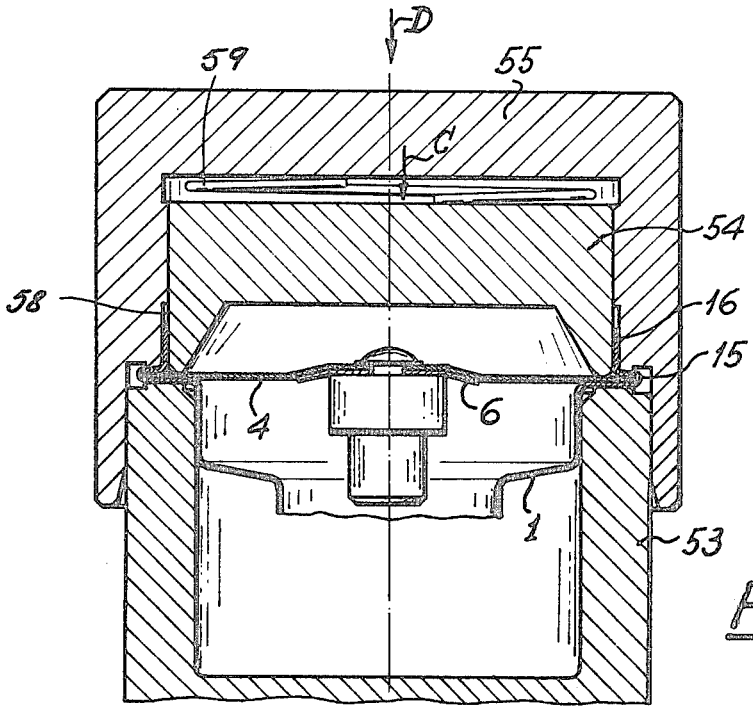
FIG. 13 is a view similar to FIG. 12, showing the final stage of assembly.

I shall now describe, with reference to FIGS. 11–13, the process for assembling the membrane 4 with housing 1 in accordance with my present invention.

FIG. 11 shows the housing 1 with its peripheral wall 1' prior to its assembly with membrane 4, wall 1' being stepped to form a shoulder 1'' facing the open end of the housing and therefore the membrane 4. The largest inner diameter of the stepped housing wall 1' exceeds the diameter of the membrane whose rim therefore remains spaced from the housing wall when the membrane is coaxially seated on shoulder 1'', as shown in FIG. 12. According to the latter Figure, housing 1 (already fitted internally with coil 11 and interrupter 9') is suspended by its stepped wall 1' from an annular edge of a cylinder 53, forming part of a tool 52, while a cylindrical mandrel 56 with an annular rabbet 57 holds down the membrane 4 and the housing 1, as indicated by an arrow A. Next, a roller 51 is pressed radially against end portion 16 to deform it inwardly into the rabbet 57 while the tool 52 is rotated about its axis 0, as indicated by arrows B, the roller having a rounded lower edge so as to leave a beveled neck 16' overhanging the rim of membrane 4. Thereafter the partly completed assembly is suspended within a cylinder 53' telescoped in a tubular die 55. The die 55 has an inner annular groove 58 accommodating the wall portion 16 between itself and a plunger 54 designed to hold down the membrane 4, e.g. under the pressure of a coil spring 59, as indicated diagrammatically by an arrow C. Finally, die 55 is brought down onto cylinder 53", as indicated by an arrow D, to flatten the neck 16" (FIG. 12) against the top of the cylinder 53' so as to seat the membrane 4 within flange 15 as discussed above with reference to FIGS. 6 and 7. The bulges 19 shown in FIG. 7 (see also FIG. 2) may be formed at the same time with the aid of suitable projections on the confronting lands of die 55 and cylinder 53'.

Figure 2:
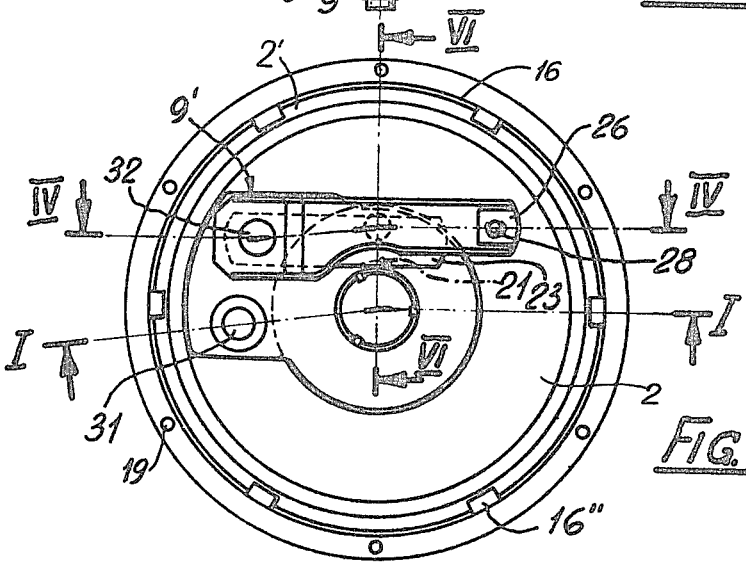
FIG. 2 is a top view of the generator housing with removal of a membrane and a resonator shown in FIG. 1.
Figure 3:
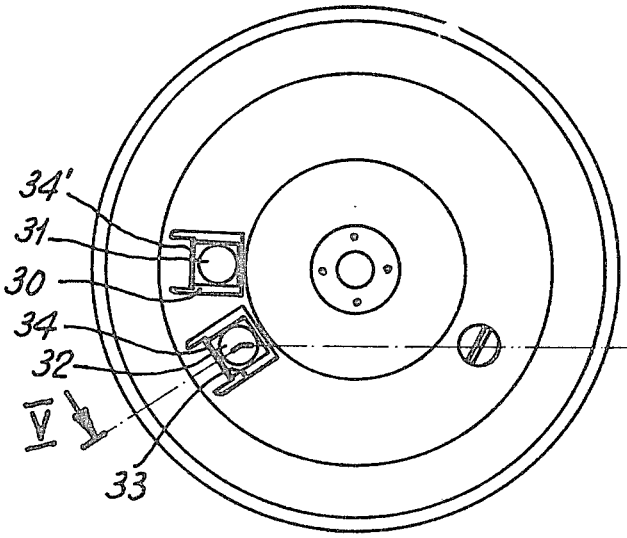
FIG. 3 is a bottom view of the assembly shown in FIG. 1.

The terminal wall portion 16 may be trimmed off to the extent that it is not needed. I prefer, however, to use that wall portion for the purpose of anchoring the bottom part 2 of the resonator shell to the housing 1, as shown in FIGS. 1 and 2. Thus, by indenting the wall portion 16 to form inbent tabs 16" engaging an annular ledge 2' of resonator bottom 2, I am able to hold that bottom in position with little or no pressure so as not materially to restrict the mobility of membrane 4. A skirt 17 of resonator top 3, formed with peripherally spaced internal recesses 3' to accommodate the tabs 16", overlies the flange 15 as an esthetic covering for the joint between housing 1, membrane 4 and resonator bottom 2, with the weight of the resonator resting mainly on flange 15.

If the diffuser-type resonator 2, 3 is replaced by a vibrating disk, as in an automobile horn of the Klaxon type, housing extremity 16 may simply form a protective enclosure around that disk.

Roller 51 may have a slightly corrugated periphery to facilitate the inward deformation of wall portion 16 by crimping. A somewhat similar crimping tool can also be used to provide this wall portion with a continuous annular lip, in lieu of tabs 16", overlying the ledge 2'.

Interrupter 9' can be preassembled outside housing 1, together with coil 11 and its holder 10, its emplacement in the housing requiring merely the insertion of rivets 31, 32 and screw 28.

I claim:

1. An electromagnetic sound generator comprising:
   - a housing of ferromagnetic sheet metal provided with an open end centered on an axis;
   - a circular ferromagnetic membrane, centered on said axis, spanning said open end;
   - an electromagnetic coil in said housing axially spaced from said membrane;
   - a ferromagnetic armature on said membrane extending axially into said coil;
   - an energizing circuit for said coil including interrupter means controlled by said armature; and
   - resonator means supported by said housing externally of said membrane, said housing having a peripheral wall forming a seat for said membrane and an end portion extending axially beyond said seat around at least part of said resonator means.

2. A sound generator as defined in claim 1 wherein said coil is provided with a ferromagnetic core axially separated by an air gap from said armature, said core having a threaded extension projecting axially from said housing for engagement with an external support.

3. A sound generator as defined in claim 1, further comprising a resilient ferromagnetic disk of a diameter less than that of said membrane but greater than that of said armature inserted between said membrane and said armature.

4. A sound generator as defined in claim 1 wherein said interrupter means comprises a leaf spring in said housing extending generally transversely to said axis alongside said armature and an arm juxtaposed with said leaf spring, said arm and said leaf spring being provided with a pair of coacting contacts normally engaging each other, said armature being mechanically coupled with said leaf spring for separating said contacts upon magnetic attraction of said armature by said coil.

5. A sound generator as defined in claim 4 wherein said leaf spring has a fixed end secured to said housing and a longitudinal edge engaged by an eccentric projection on said armature at a location remote from said fixed end.

6. A sound generator as defined in claim 5 wherein said arm has an extremity overlying said fixed end with interposition of an insulating strip enfolding said fixed end, said strip having a longer leg between said leaf spring and said arm and having a shorter leg on the side of said leaf spring remote from said arm.

7. A sound generator as defined in claim 6 wherein said longer leg has a generally transverse edge intersecting said longitudinal edge at an acute angle pointing toward said location.

8. A sound generator as defined in claim 7 wherein said longer leg is provided with a surface groove paralleling said generally transverse edge.

9. A sound generator as defined in claim 7 wherein said contacts are offset from a centerline of said leaf spring toward the side opposite said longitudinal edge.

10. A sound generator as defined in claim 6 wherein said arm is flexible and has an end remote from said extremity adjustably mounted for axial displacement relative to said coil with axial entrainment of said leaf spring through said longer leg.

11. A sound generator as defined in claim 5 wherein said armature is rotatable about said axis for displacing said projection along said longitudinal edge.

12. A sound generator as defined in claim 1 wherein said peripheral wall has an external annular flange with two parallel, axially spaced plies forming said seat and bracketing the rim of said membrane.

13. A sound generator as defined in claim 12 wherein said flange has a bight portion radially separated from said rim by an internal annular clearance.

14. A sound generator as defined in claim 12 wherein said membrane is provided with a plurality of peripherally spaced apertures adjacent said rim, said plies being provided with confronting bulges entering said apertures.

15. A sound generator as defined in claim 14 wherein said resonator means comprises a resonant chamber anchored to said housing by said end portion.

16. A sound generator as defined in claim 15 wherein said chamber has a shell split along a plane transverse to said axis into two interconnected parts, said end portion having inbent tabs engaging one of said parts proximal to said membrane.

* * * * *